US005417599A

United States Patent [19]

Evans

[11] Patent Number: 5,417,599

[45] Date of Patent: May 23, 1995

[54] SWIN FIN HAVING MULTIPLE INTERCHANGEABLE COMPONENTS

[76] Inventor: Robert B. Evans, 28 Anacapa St., Santa Barbara, Calif. 93101

[21] Appl. No.: 177,331

[22] Filed: Feb. 25, 1994

[51] Int. Cl.[6] ..... A63B 31/10

[52] U.S. Cl. ..... 441/64

[58] Field of Search ..... 441/61-64

[56] References Cited

U.S. PATENT DOCUMENTS

| | | | |
|---|---|---|---|
| 2,423,571 | 7/1947 | Wilen | 441/64 |
| 2,672,629 | 3/1954 | Trell | 441/64 |
| 4,007,506 | 2/1977 | Rasmussen | 441/64 |
| 4,773,885 | 9/1988 | Ciccotelli | 441/64 |
| 4,838,824 | 6/1989 | McCredie | 441/64 |
| 4,857,024 | 8/1989 | Evans | 441/64 |
| 4,929,206 | 5/1990 | Evans | 441/64 |
| 4,940,437 | 7/1990 | Piatt | 441/61 X |
| 4,944,703 | 7/1990 | Mosier | 441/61 X |
| 5,041,039 | 8/1991 | Chang | 441/64 |

FOREIGN PATENT DOCUMENTS

| | | | |
|---|---|---|---|
| 2410488 | 6/1979 | France . | |
| 2128096 | 4/1984 | United Kingdom | 441/64 |
| 1251934 | 8/1986 | U.S.S.R. | 441/64 |
| 9409859 | 5/1954 | WIPO | 441/64 |
| 9415676 | 7/1994 | WIPO | 441/64 |

*Primary Examiner*—Sherman Basinger
*Attorney, Agent, or Firm*—Cislo & Thomas

[57] ABSTRACT

This invention relates to a swim fin (10) adapted to be worn on a foot of a swimmer for the purpose of varying the effect of the swimmer's leg strokes. In one preferred embodiment of the invention a sole plate (14) having a rear portion (22) of a roughly rectangular shape and front portion (18) of a roughly trapezoid shape is provided. The sole plate (14) is larger than the swimmer's foot. The sole plate may be secured to the sole swimmer's foot. In one of the preferred embodiments, this consists of a pair of flaps (34) integral with the rear portion (22) of the sole plate (14) plus adjustment straps (42) and a heel strap (46). The sole plate has a plurality of mounting holes or slots (54), which will be clear of the foot after the sole plate (14) is securely fastened to the foot. Also provided in the preferred embodiment are sets of water channeling vanes (58). The vanes (58) may be of many different designs including straight or curved in one or two dimensions. They may be attached to the upper or lower surface of the sole plate (14) through holes or slots (54). One of the preferred embodiments further includes a fin extension (90), for attachment to the outer end (18) of the sole plate (14) and a speed pod for attachment to the center of the underside (30) of the sole plate (14). The fin of the invention (10) may be made of a material such as natural rubber, synthetic rubber, silicone polymer, polyurethane polymer, or composites of these materials. Additionally, the modular components of the invention may be provided in kit form with a template to determine module fixation, so that existing fins can be modified to receive the vanes (58) and the speed pod (98).

96 Claims, 6 Drawing Sheets

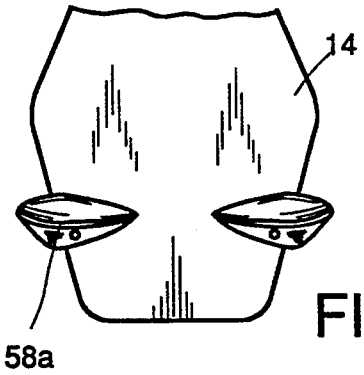
FIG. 4a.
FIG. 5a.
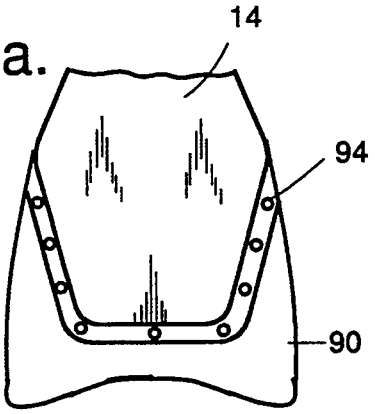
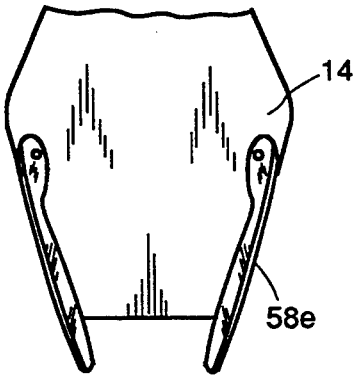
FIG. 4b.
FIG. 5b.
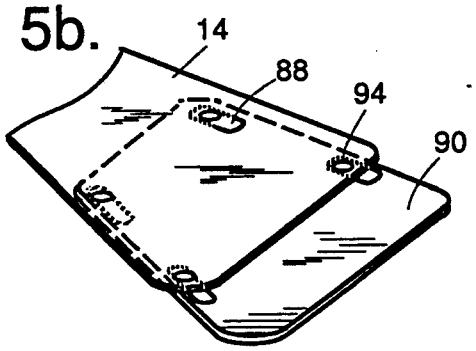
FIG. 6a.
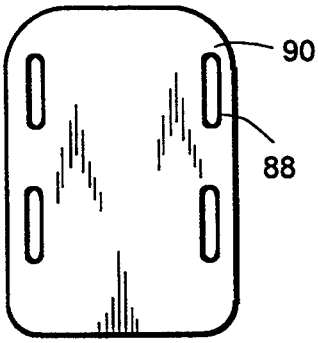
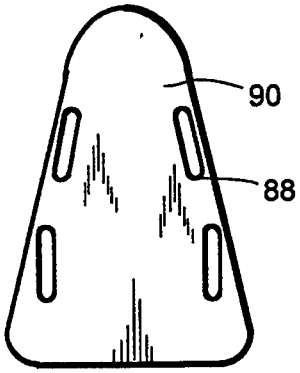
FIG. 6b.
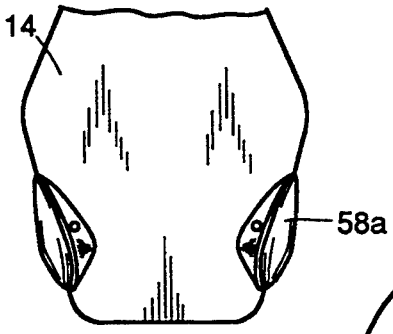
FIG. 4c.
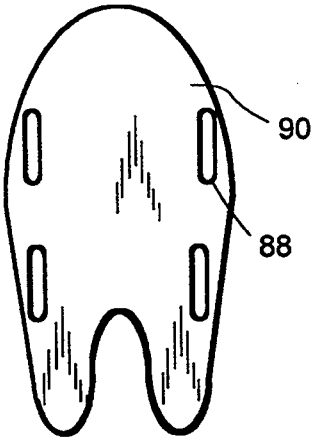
FIG. 6c.
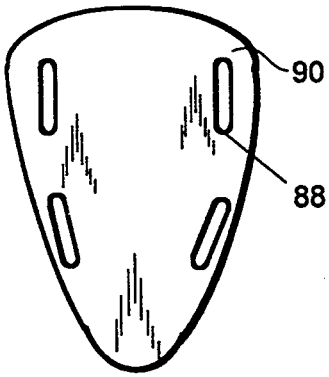
FIG. 6d.

-2

-1

0

1

2

3

SWIM FIN HAVING MULTIPLE INTERCHANGEABLE COMPONENTS

This application is predicated upon PCT/US92/09002 filed on 26 Oct. 1992 now international publication WO94/09859 published 11 May 1994.

TECHNICAL FIELD

This invention relates to the field of swim fins. More particularly this invention relates to the modification of swim fins which can vary the effect of the swimmers foot and leg stroke on the water through which the swimmer swims, for various end results.

BACKGROUND ART

Human beings, with proper training, are capable of swimming on the surface of the water. For brief periods, and with proper equipment for extended periods, swimmers can also swim under the surface of the water. People have long recognized, however, that the human anatomy is not designed to facilitate rapid and easy movement through the water. Most aquatic animals can swim much better and faster than the speediest human being.

In an effort to improve man's swimming abilities, a number of inventors have designed and produced fins adapted to be worn on the feet while swimming. Generally, fins have a foot retaining portion and a relatively large blade extending in a forward direction with respect to the body. Most are made from elastomeric materials such as rubber, polyurethane or silicones. Newer fins are made from combinations of these materials and may be reinforced with strengthening fillers such as graphite.

Some fins were designed to emulate the anatomy of aquatic animals. An example is U.S. Pat. No. 2,423,571 granted to Wilen in 1947. Wilen's designs are graceful and fluted and the inventor specifically states that he intended to copy the design of fish tails. Other fins were designed to take advantage hydrodynamic principles One example is U.S. Pat. No. 4,209,866 ranted to Loeffler in 1980. Loeffler presents a fin with a pivotally mounted blade which increases swimming efficiency. Another example is U.S. Pat. No. 3,183,529 granted to Beuchat in 1965. This design has a series of slots in the blade which jet water in the direction of swimming when the swimmer executes his downstroke. This is claimed to increase swimming speed.

Still others are designed to take advantage of the properties of newly available materials. U.S. Pat. Nos. 4,929,206 and 4,857,024 describe fins with upwardly curving blade tips. This design results in an opening of the blade as the swimmer executes a power or downstroke and a snapping action of the tips as the swimmer executes an upstroke. The opening action on the downstroke increases propelling force while the snapping action on the upstroke decreases the amount of energy needed by the swimmer to reposition his leg for another downstroke.

Much of the prior art equates power, resistance and propulsion. However, resistance is opposition of the water to the motion of the fin. The higher the resistance the harder the swimmer must work. Propulsion is the process of causing a body to move by exerting a force against it. In swim fins this can be equated to movement of the water over, under and through the blade. Power is force that moves the fin. It can only be provided by the swimmer's leg muscles.

To date, however, it has been the objective of all fin designers to design and produce fins that increase the swimmer's speed. They have attempted to do this by designing fins that increase propulsion. Among the designs that have been produced are fins having ribs (U.S. Pat. No. 4,820,218), flexible canals (U.S. Pat. No. 4,738,645), baffles (U.S. Pat. No. 4,627,820), stabilizers (U.S. Pat. No. 3,913,158), leading edges (U.S. Pat. No. 3,810,269), upcurving wingtips (U.S. Pat. No. 4,929,206 and 4,857,024), and hydrofoils (U.S. Pat. No. 4,944,703).

Battens provide either more or less resistance, however the surface area of the fin and thus the effective propulsion is not changed. Ribs are fixed and cannot be varied according to the needs of the swimmer and water conditions.

Baffles and vents combine forces exerted by the swimmer with water pressure forces moving through the blade. Such openings will not allow sufficient flow of water thus creating a backpressure which increases resistance. Stabilizers and leading edges are fixed and stationary, and will not respond to changes in water pressure or forces exerted by the swimmer.

As far as is known, no one has tried to design a fin for any other purpose. There are no fins designed to be made more resistive or more propulsive or both, depending on the swimmer's needs. There are no fins designed to help in rehabilitating physically handicapped people. There are no fins designed to compensate for disparities between one side of the swimmer's body and the other side. There are no fins designed to enable swimmers to achieve adequate exercise levels in a small pool. There are no fins designed to warm up muscles in preparation for competition. Development of a swim fin which could fulfill all of these requirements would represent a great improvement in the field of swim fin design and would satisfy a long felt need of the swimming public, disabled persons, divers, snorkelers and competition swimmers.

DISCLOSURE OF THE INVENTION

This invention, in its simplest form relates to a truncated swim fin or sole plate adapted to be worn on the foot of a swimmer for the purpose of varying the effect of the swimmer's leg strokes. By the addition and position of selected components the swim fin can be made more resistive or more propulsive or both, depending on the swimmer's needs. In one embodiment of this invention, the swim fin has a sole plate having a rear portion of roughly rectangular shape and a front portion of roughly trapezoid shape. The sole plate is fairly thin, of fairly constant thickness and is generally flat. Thicknesses of about ¼ inch work quite well. The sole plate should be larger than the largest foot that can be expected in the general population. Smaller sizes will obviously be needed for a child's foot and others. The sole plate has a plurality of mounting holes or slots, which will be clear of the foot after the sole plate is securely fastened to the foot. In other embodiments of the invention, an elongated swim fin is the basic modular component.

A means of securing the sole plate or fin to the sole of the swimmer's foot is provided. In the preferred embodiment, integral with the rear portion of the sole plate or fin, is a pair of arcuate shaped flaps which are comfortable to the instep of the foot of a swimmer. These flaps extend upwards and forwards from the rear portion of the fin or sole plate and form a tunnel or channel of variable diameter into which the swimmer's foot may be inserted. To complete the securing means are heel straps, attached to the arcuate shaped flaps, and another set of straps attached over the top of the arcuate shaped flaps which can adjust the diameter of the tunnel or channel formed between the flaps. The effective lengths of these pairs of straps can be adjusted, for snug fit around a foot of any size, by any conventional means such as buckles or hook and pile fasteners.

Also provided in one of several embodiments are sets of water channeling vanes. Each vane has a mounting hole through which it can be fastened to one of the holes or slots in the sole plate or fin. The vanes may be of many, selected and different designs, including straight or curved in one or two dimensions depending upon the end results desired. The mounting holes may be located at one end or centrally of the sole plate or fin.

Means for attaching the vanes to the sole plate or fin are also provided. This may be accomplished in many different but standard ways. It may be done, for example, with nuts and bolts or with threaded inserts and bolts. The inserts may be molded into the holes in the vanes. Bolts may be suitably modified for ease of turning with the fingers. The bearing surfaces of the bolts or the nuts or both may be knurled so that, when fastened down, the vanes will not easily rotate or change position unless so desired by the user. As another assembly aid, the holes or slots in the fin or sole plate may be designed to retain the nuts and prevent them from turning, for relatively immobile association with the fin or sole plate.

The sole plate, or fin and flaps and vanes, as is typical of swim fins in general are made of a rigid or flexible material such as natural rubber, synthetic rubber, silicone polymer, polyurethane polymer, or foam compositions, or composites of these materials. Preferably, the sole plate or fin and flaps are formed as a one piece integral molding. It is possible to attach vanes of different designs to various, selected locations on the upper alone or upper and lower surfaces of the sole plate and likewise for the basic, modular swim fin.

Other modifications of the embodiments are possible. For example, one flap joining the two sides of the sole plate or swim fin may be provided instead of two. This single flap may be shaped like a tunnel or channel of decreasing diameter into which the swimmer's foot may be inserted. Or an essentially hemispherical pod may be attached to the center of the lower surface of the sole plate or swim fin. Such a pod diverts water from the central portion of the lower surface of the sole plate or swim fin, a known dead spot, in order to permit greater swimming speed. Additionally, a fin-like extension of essentially truncated triangular shape may be attached to the fore portion of the sole plate. This makes the shape of the sole plate similar to a conventional fin, providing greater surface area and permits greater swimming speed.

The basic derived attributes of this invention may also be found by providing modular components in kit form to swimmers who already have swim fins and do not desire to purchase others. The kit contain sets of vanes, fasteners for the vanes and a template for alignment purposes for drilling holes, for example, in existing fins. The owner simply drills holes in his existing fins, as indicated in the template and attaches vanes or other modular components in order to achieve the desired effect that the swimmer wants.

An important attribute of this invention resides in the vane components. They can be attached to any point on the upper and lower surfaces of the specially provided sole plate or to the blade of any existing fin in order to make the fin more resistive or more propulsive as desired. This allows the swimmer to target certain muscles for resistance and also to channel water past the fin or sole plate in order to provide more propulsion. For example, should a swimmer have a hip joint replacement, that hip requires more therapy than the other hip and selective placement of modular elements, to increase water resistance, provides this capability.

An appreciation of the other aims and objectives of the present invention and a more complete and comprehensive understanding of it will be readily apparent by referring to the accompanying drawings, wherein like numerals of reference designate like elements throughout and studying the following description of the various modes of carrying out the disclosed invention.

BRIEF DESCRIPTION OF DRAWINGS

FIG. 1A is similar to the embodiment depicted in FIG. 1, but illustrating an alternate fastening means.

FIG. 1B is similar to the embodiment depicted in FIGS. 1 and 1B, but illustrating still another alternate, fastening means.

FIGS. 4*a*–4*c* inclusive show partial views of several varieties of the water channeling vanes applied to the sole plate, for example, of the present invention.

FIGS. 5*a* and 5b show partial views of the addition of several varieties of fin extension modules to the sole plate, for example, of the present invention.

FIGS. 6*a*–6*d* inclusive illustrate several alternate shapes for fin extension modules.

FIGS. 7*a*–7*d* inclusive illustrate the manner in which the enlarged fin extensions or modules of various shapes may be secured to a pair of sole plates to make a uni-fin or the like.

BEST MODE FOR CARRYING OUT INVENTION

Figure 1:
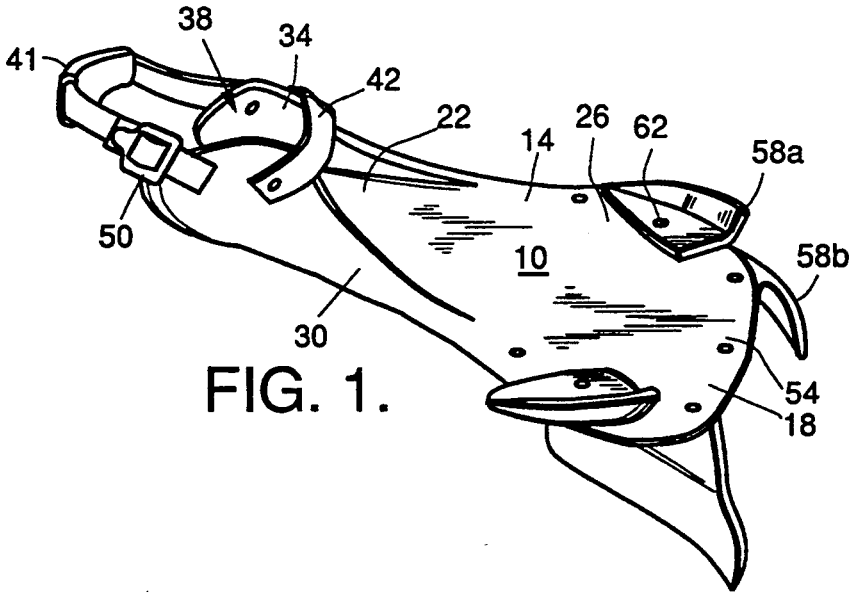
FIG. 1 is a top perspective view of one embodiment of the present invention.

FIG. 1 shows a top, perspective view of the swim fins of the present invention. The fin 10 comprises a main portion sole plate 14 forming the basic component to which various modules, as will become clear, may be secured. The sole plate 14 has a front portion 18, a rear portion 22, and an upper surface 26 and a lower surface 30. The sole plate 14 is essentially flat, planar and about ¼ inch thick. The front portion 18 may have a trapezoidal shape or a roughly and/or essentially trapezoidal shape. The front portion 18 can act as a substrate for the attachment of vanes or other water channeling means. The rear portion 22 has a rectangular and/or roughly rectangular shape. The whole sole plate 14 is larger than a swimmer's foot, not shown. It is understood that only one swim fin will be described and that swimmers utilize two such fins when swimming or exercising using the invention.

In one of the preferred embodiments, integral with top surface 26 of rear portion 22 are a pair of extending, arcuate-shaped flaps 34. Flaps 34 extend upward and forward from the rear portion 22 and may additionally curve inward slightly with reference to the center line of sole plate 14. Flaps 34 form a tunnel or channel 38 into which the swimmer's foot is received. The flaps 34 provide support to the sides of the swimmer's foot and forms the means whereby the sole plate 14 does not significantly twist during use.

In order to adjust the size of the tunnel or channel 38 and assure that the fin 10 is securely attached to the swimmer's foot, two pairs of adjustment straps 42, and 46 are provided. The top straps 42 are attached to the flaps 34 so that they will pass over the top or instep of the swimmer's foot. The top straps 42 adjust the size or diameter of the tunnel or channel 38 so that the swimmer's foot will be firmly held within the formed channel and between the arcuate flaps 34. The heel straps 46 are attached to the lower portion of flaps 34 so that they will pass around the heel of the swimmer's foot. The purpose of the heel straps 46 is to assure that the swimmer's foot is retained within the confines of the tunnel or channel 38 so that the foot will not slip out of the tunnel or channel 38 to the rear.

Figure 1A:
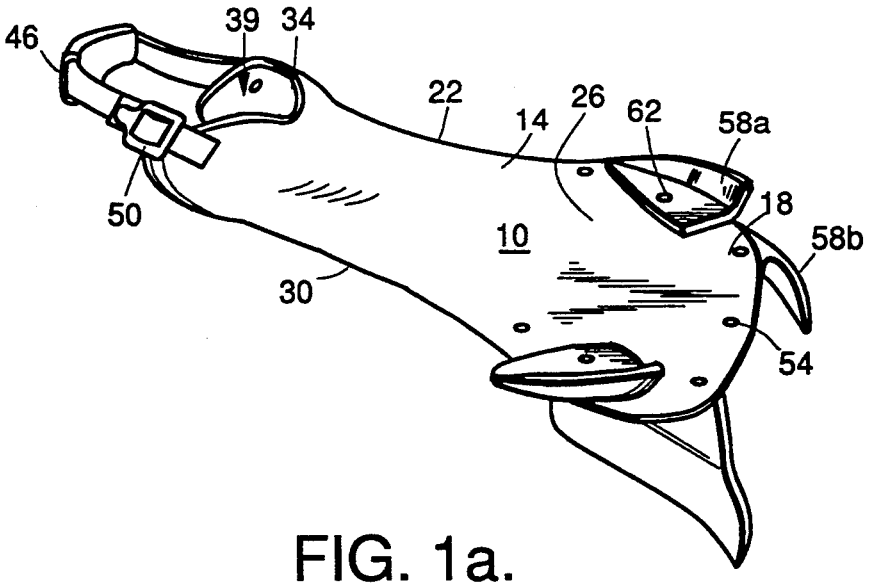
FIGS. 1A and 1B represent alternate ways of fastening the invention to the foot.
Figure 1B:
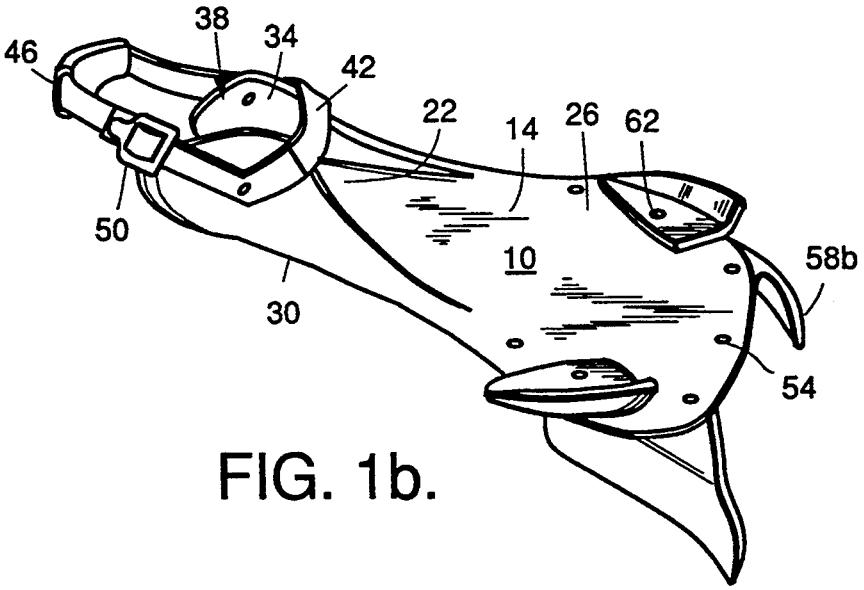

Both pairs of straps 42 and 46 may be secured and adjusted with buckles 50 or hook and pile fasteners such as Velcro TM. The purpose of the flaps 34, straps 42, 46 and buckles 50 or hook and pile fasteners, is to securely associate the sole plate 14 with the sole of the swimmer's foot. It is obvious from the prior art, and the Inventor's own prior U.S. Pat. Nos. 4,857,024 and 4,929,206 that other association designs will work equally well. For example, one flap 34, thereby forming a pocket 39, could be provided fastened to the rear 22 of the sole plate, thus, forming a tunnel, channel or pocket 39 of reducing diameter, into which the foot is inserted. This modification is illustrated in FIG. 1*a*. In this case the top straps 42 would be unnecessary.

In one of the preferred embodiments, the sole plate 14 and flaps 34 are integral or molded in one piece. The sole plate 14 and flaps 34 ideally are made from a flexible or rigid material. Commonly used fin materials, such as natural rubber, synthetic rubber, polyurethane elastomers, silicone elastomers, or combinations of these materials may be used. Furthermore, these materials may be filled with a reinforcing material such as graphite or the like.

Sole plate 10 is provided with a number of spaced and aligned holes or slots 54. It is through these holes or slots 54 that the modular elements or water channeling vanes 58 are attached. The water channeling vanes 58 may have a variety of different shapes: right angle vanes 58*a* and winglets 58*b* are illustrated in FIG. 1. Each vane 58 illustrated in this instance has a single mounting hole 62, which may be located anywhere on the vane 58.

Vanes 58*a* and 58*b* are shown attached, in a specific position and with a specific orientation, to the top surface 26 and the bottom surface 30 of sole plate 14. It should be recognized, however, that sole plate 14 may be used very effectively without any vanes 58 attached. Further, the vanes 58*a*, 58*b* may be attached singly rather than in pairs, at other locations 54 on sole plate 14, on the top surface 26 or the bottom surface 30 of sole plate 14 and with different orientations. The devices of this invention, since they have a variety of interchangeable modular components, may be assembled into many different configurations according to the swimmer's desires.

Figure 2A:
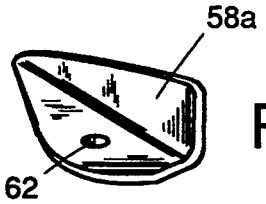
FIGS. 2*a*–2*f* inclusive illustrate perspective views of several modular components of water channeling vanes of the invention.
Figure 2F:
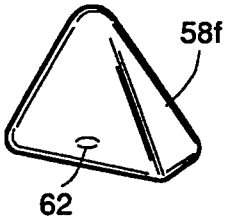
Figure 2B:
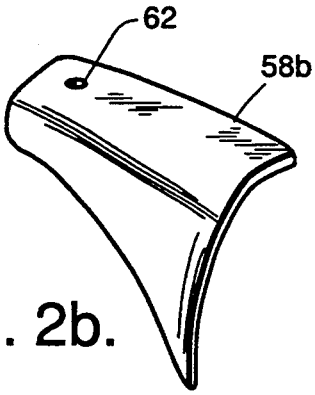

FIGS. 2*a–f* illustrate a variety of differently configured vanes 58. As illustrated in FIGS. 2*a* and 2*b*, the right angle vane 58*a* and winglet 58*b* vanes have already been mentioned. Also illustrated are three configurations of whiskers 58*c*, 58*d*, 58*e* and a solid wing 58*f*. The solid wing 58*f* exerts a pressurization/depressurization action similar to that of an aircraft wing. Each of the vanes 58 illustrated has a single mounting hole 62. The location of the mounting hole 62 is optional but is dictated by the end function of the vane 58. In the right angle vane 58*a* and the solid wing 58*f*, the hole 62 is located centrally. In the other illustrated varieties of vanes 58*b, c, d, e* the hole 62 is located towards one end. While preferred vanes 58 have been illustrated, it should be recognized that other vane designs 58 are possible with varying numbers of holes 62 and different hole locations. The winglet vanes 58*c*–58*e* will slightly bend or flex when in use with sole plate or fin, thereby producing various desired end results for the swimmer. The vanes 58 may also be made from standard rigid and flexible fin materials such as natural rubber, synthetic rubber, polyurethane elastomers, silicone elastomers, or foam compositions or combinations of these materials. Furthermore, these materials could be filled with a reinforcing material such as graphite. The purpose of these vanes 58 is to channel water in specific directions as it passes over the fin 10, for example.

Figure 3A:
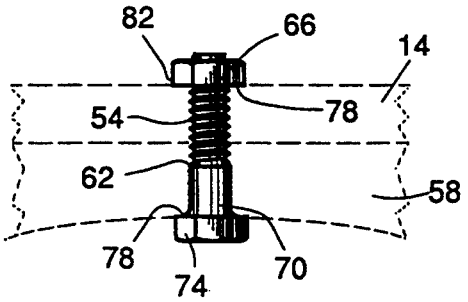
FIGS. 3*a*–3*c* illustrate fragmented, cross-sectional views of various means of attaching the vanes to the sole plate or swim fin of the invention.
Figure 2C:
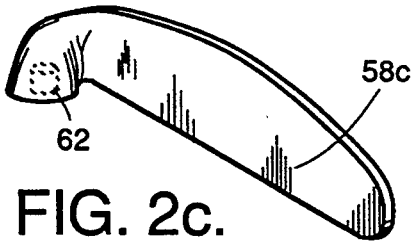
Figure 3B:
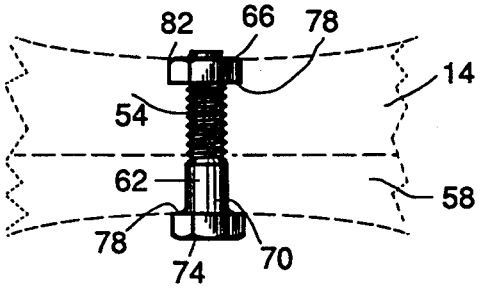
Figure 2D:
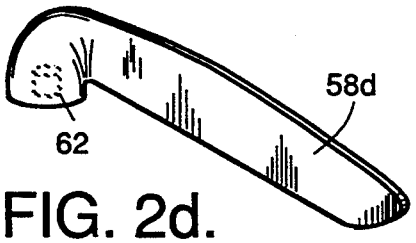
Figure 2E:
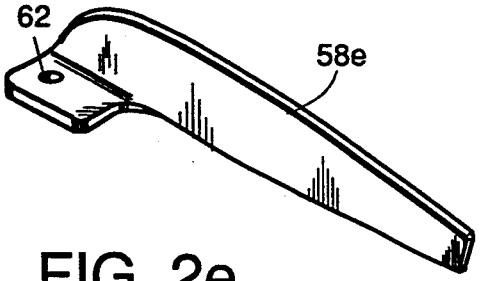
Figure 3C:
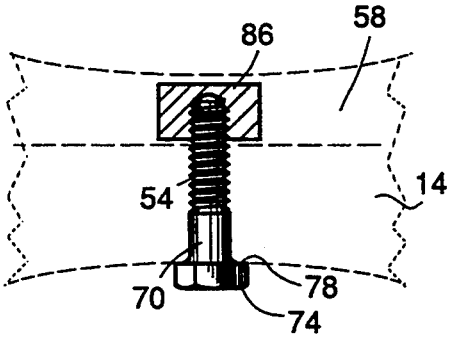
Figure 7A:
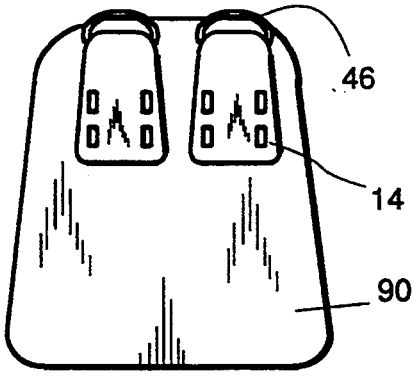
Figure 7B:
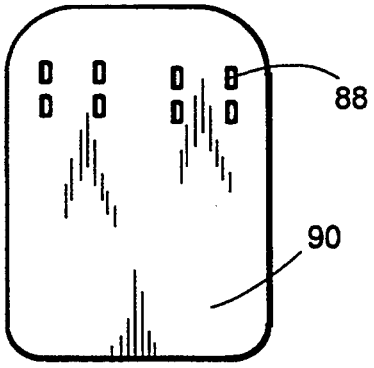
Figure 7C:
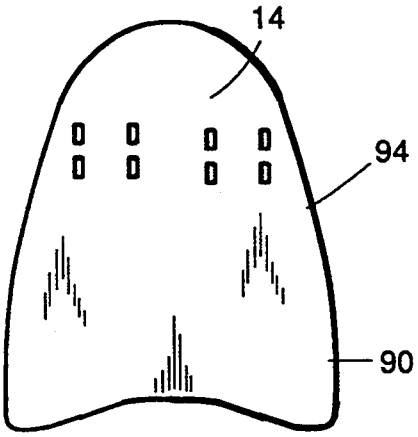
Figure 7D:
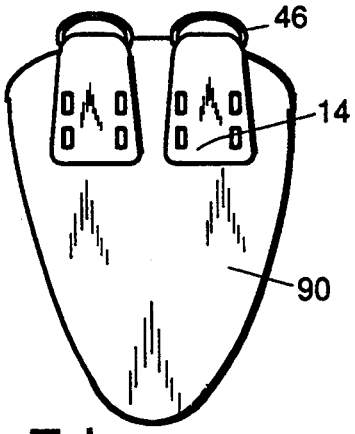

The vanes 58 can be attached to the fins by a variety of standard methods. FIGS. 3*a–c* show cross-sections of some typical methods of attachment. FIG. 3*a* shows attachment with a nut 66 and bolt 70. When this method is chosen, the nut 66 and bolt 70 should preferably be manufactured from corrosion resistant, nickel plated or chromium plated steel. Alternatively, plastic bolts 70 and nuts 66 may be utilized. Further, the bolt 70, should be provided with a large head 74 for ease of assembly by the fingers. Also, the bearing faces 78 of the nut 66 or the bolt 70 or both should be knurled so that fastener clamping force will not be lost during use of the fin 10. It may also be advisable to provide sockets 82 around the fastening holes or slots 54 in the sole plate 14 or the fastening holes 62 of the vanes 58 shaped like the exterior of the nuts 66. This provides a simple way to prevent the nuts 66 from rotating. FIG. 3*b* illustrates sockets 82 in the sole plate 14.

Alternatively, fastening may be accomplished with threaded inserts 86 and bolts 70. The inserts 86 are molded into the vanes 58 so as to be accessible from the outside. Again the bolts 70 are fabricated of corrosion resistant materials and provided with large heads 74 and serrated bearing surfaces 78. It should be obvious that other methods of attaching the vanes to the sole plates or fins may be devised, using standard fastening techniques.

As was mentioned previously, a single vane 58, a pair of vanes 58 or multiple pairs of vanes 58 may be attached to sole plate 14 or to conventional fins as will be described. Additionally, vanes may be attached to the top surface 26 or the bottom surface 30 of the sole plate 14 at various locations 54 and with various orientations. FIGS. 4*a–c* illustrate the sole plate 14 with a variety of vanes 58 attached to it in different orientations. Although only a few are illustrated in FIGS. 4*a–c*, it should be obvious that many different combinations are possible.

Each vane 58 has a different effect on the swimmer's capabilities. The combination shown in FIG. 4*a* will tend to reduce swimming speed. This is useful if the swimmer must exercise in a small pool or he desires to preferentially exercise the muscles in his thigh. The combination shown in FIG. 4*b* focuses the water into the working area of the fin resulting in greater propulsion. The orientation shown in FIG. 4*c* results in more stability for the swimmer. It can be seen that it is possible to attach vanes 58 of different designs to many locations 54 on the upper surface 26 and lower surface 30 of sole plate 14 on to a conventional fin. This enables the swimmer to swim faster, exercise specific muscles, compensate for physical disparities between the two legs, or swim more slowly, as desired.

The basic modular unit or sole plate 14 of this invention does not have the broad, roughly fluke shaped tip or blade of many prior art fins. Therefore, it cannot produce the power of many prior art fins and it may not be useful for some purposes such as SCUBA diving. However, fin extension 90 may be provided which may be fastened to the sole plate 14 with fasteners 94 as illustrated in FIGS. 5*a* and *b*. In FIG. 5*a* an extension 90 is shown joined to the end of sole plate 14 by what is essentially an overlap joint. The two pieces are joined by spaced fasteners 94. FIG. 5*b* illustrates an alternate manner of fastening an extension 90. In this version the extension 90 is longer and extends underneath sole plate 14. The extension 90 is provided with a series of slots 88 so that its position in relation to the sole plate 14 may be infinitely varied. With either method of attachment, the fin 14 will have all the capabilities of a regular swim fin, i.e. it can develop enough power for all uses, and in addition various vanes 58 may be fastened to it, as previously described. Thus, this invention fulfills multiple purposes.

The extension 90 may have a variety of different shapes. Some examples are shown in FIGS. 6*a–d*. The extension 90 can even be made so that a pair of sole plates 14 may be fastened as illustrated in FIGS. 7*a–d*, to thereby produce a mono-fin, designed to receive both feet of the swimmer. Referring to FIGS. 8*a–g* inclusive it will be seen that most fins sold today have a foot retaining portion ,and a large, triangular shaped blade 92 extending forwards. This invention can also be provided to swimmers who already have such fins and do not wish to purchase another set. In this case a kit is provided to the swimmer, consisting of a template, not shown, an assortment of vanes 58 and means 94 for fastening the vanes 58. The template determines where the swimmer is to drill holes 54 in the blades 92 of his existing swim fins. The swimmer then fastens the vanes 58 to his fins in any desired combination. FIGS. 8*a–g* illustrate some of the variety of possibilities that may result from use of the modular elements making up the kit. Swimmers who already have fins would in this way be able to realize some of the advantages of this invention without resort to purchasing the basic sole plate, substrate or fin.

Figure 9:
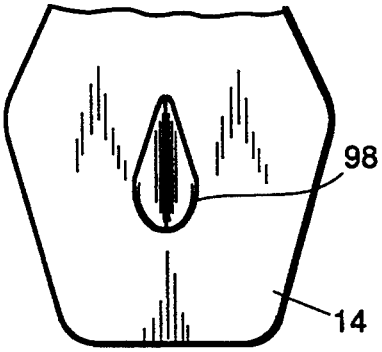
FIG. 9 is a fragmented view of to the sole plate of the present invention to which has been affixed a speed pod module.

Referring to FIG. 9, one additional modification is also possible for this invention. It is known that there is a dead spot in the middle of the underside of any fin. Therefore, a speed pod 98 is also provided as part of this invention. The speed pod 98 is shaped like a streamlined hemisphere: in other words it has a tear drop shape. The speed pod may be any convenient size and may be made from high density foam, or solid plastic. It can even be filled with a heavy material such as lead.

The speed pod 98 can be attached to the top surface 26 or underside surface 30 of the sole plate 14 or an existing fin using, preferably, bolt 70 and threaded insert 86 as previously described. Use of the speed pod 98, by diverting water from the dead spot in the middle of the sole plate 14 or any fin, will enable the swimmer to swim faster. If the pod is made of foam, it will keep the swimmer's feet high in the water. If the pod is made from a dense solid plastic or is filled with lead, it will make the swimmer's feet sink, thus making his legs work harder for additional exercise.

Figure 10:
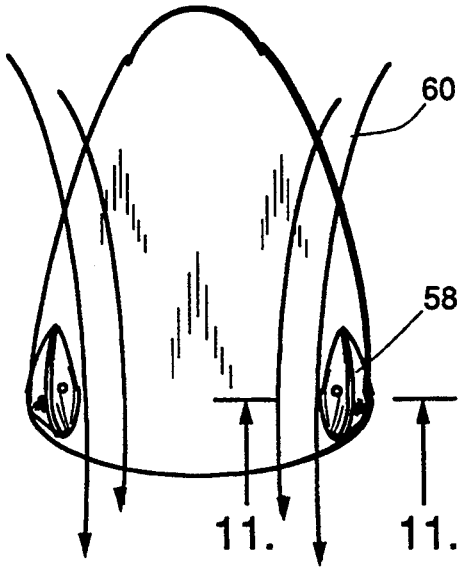
FIG. 10 illustrates water flow over a fin of the present invention as it moves through the water.

FIG. 10 illustrates water flow over one embodiment of swim fin 10 of the invention as it travels through the water. Water flow is shown by the arrows 60. Water flow in direction of the arrows 60 will differ as different vanes 58 are attached to sole plate 14 or a conventional fin. Water flow will also differ as different vanes 58 are attached in different positions on the upper surface 26 and lower surface 30 and as each is turned to a different angle. In addition, the structure of some modular vanes 58, away from the attachment point 62, allows freedom of movement in response to forces produced by water flow. The modular vanes 58 flex from their normal fixed position relative to blade 92 or sole plate 14 allowing the water to pass to the rear of the blade 92 or sole plate 14. This increases the propulsive forces in the vertical direction thus increasing fin efficiency.

Figure 11:
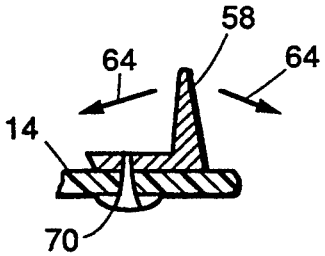
FIG. 11 is a cross section taken along the line 11—11 of FIG. 10 and illustrates how the water channeling vanes flex as a fin of the present invention moves through the water.
Figure 8A:
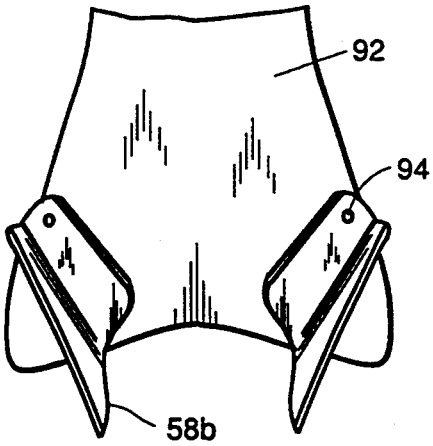
FIGS. 8*a*–8*g* inclusive illustrate partial views of addition of several varieties of fin modules to other types of conventional swim fins.
Figure 8D:
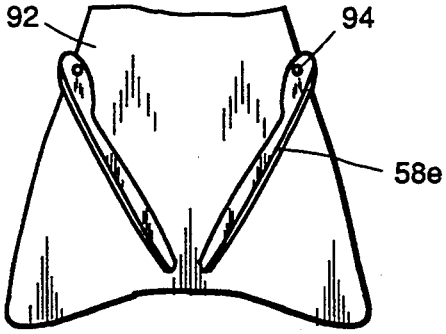
Figure 8B:
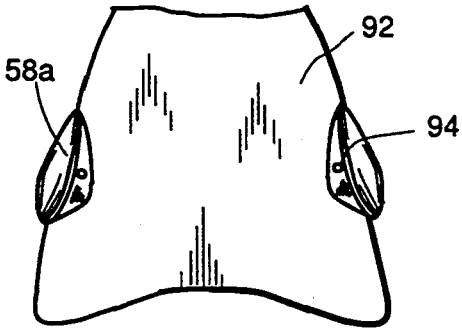
Figure 8E:
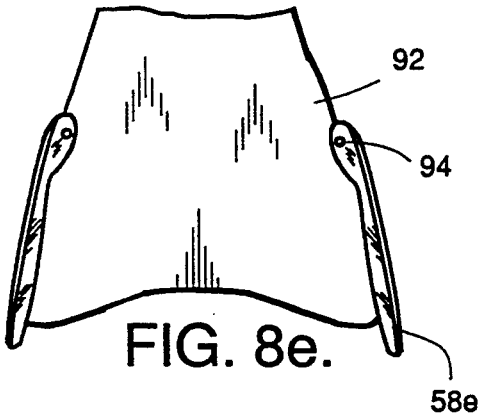
Figure 8C:
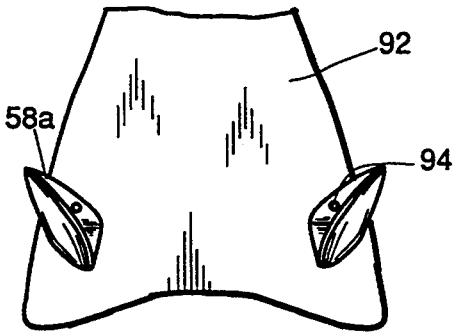
Figure 8F:
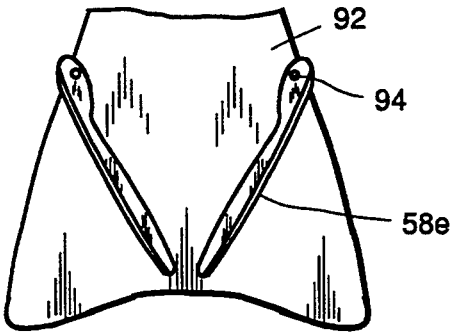
Figure 8G:
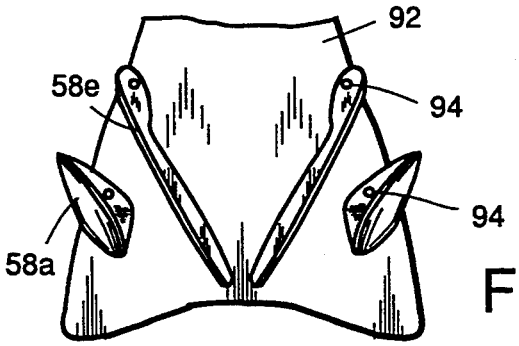
Figure 12A:
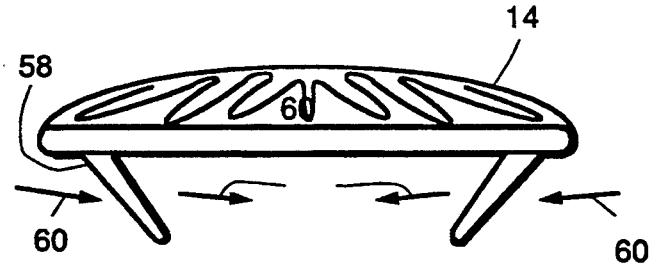
FIG. 12*a*–12*f* inclusive are schematic frontal views of a fin of the present invention, showing flexing of the various modules and water flow during the up and down strokes of a fin of the invention.
Figure 12B:
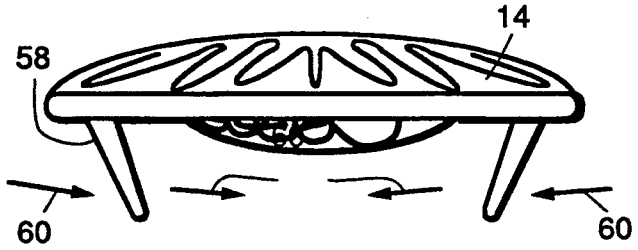
Figure 12C:
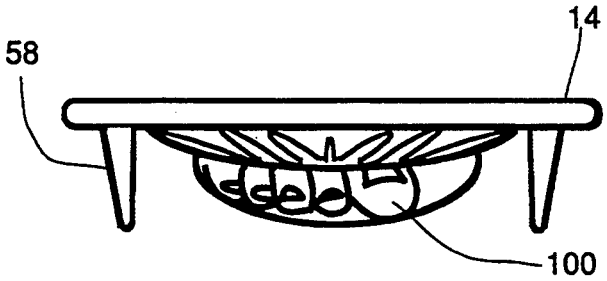
Figure 12D:
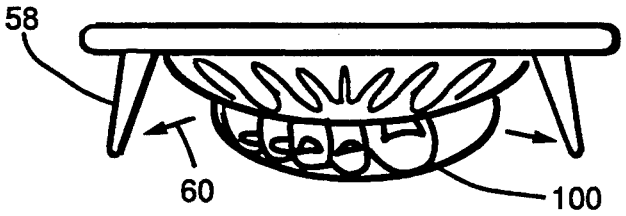
Figure 12E:
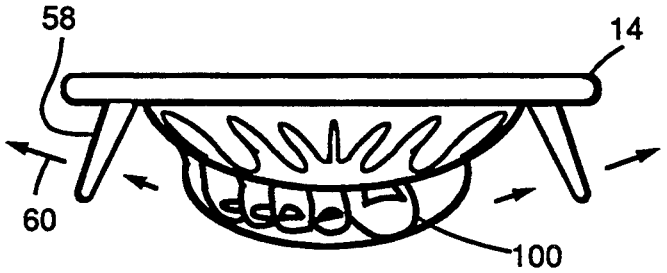
Figure 12F:
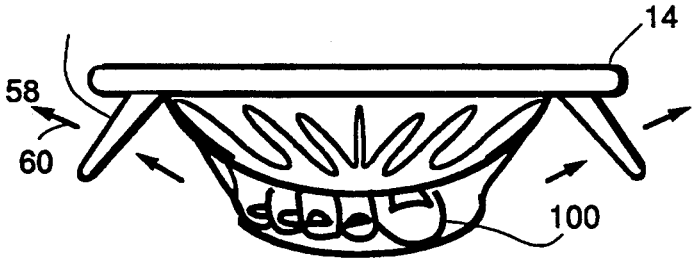

FIG. 11 illustrates how the vanes 58 flex as the swim fin 10 moves through the water. The vane 58 flexes inward and outward as shown by the arrows 64.

Referring to FIGS. 12*a–f* it will be seen how the entire swim fin 10 flexes and how water flows as the swimmer executes his up and down strokes. The position shown as 0 is essentially neutral and neither the sole plate 14 nor the vanes 58 are flexed from their normal positions. In this position the swimmer's toes 100 are clearly visible. As the swimmer executes successively increasing upstrokes, illustrated at positions −1 and −2, the sole plate 14 flexes upwards, the vanes 58 flex inward and water flows inward as shown by the arrows 60. As the swimmer executes successively increasing downstrokes, illustrated at positions 1, 2 and 3, the sole plate 14 flexes downwards, the vanes 58 flex outward and water flows outward as shown by the arrows 60.

The advantages of the water channeling vanes 58 described above are that they can be placed at any desired location depending on the surface configuration of the conventional fin or the sole plate 14. They can be placed at the side so as to create a leading edge or at the trailing edge so as to continue water flow beyond the surface area of the fin blade 92.

All swim fins create turbulence or vortices as the swimmer swims through the water. The locations of these vortices or areas of turbulence will vary according to the design of the blade. The water channeling vanes 58 can also be placed at any point along the conventional swim fin blade 92 or sole plate 14 in order to limit these vortices or areas or turbulence as well as eddies and dead spaces. A uniform pressure wave moving past a fin will propel a swimmer through the water much better than a turbulent pressure wave. In this way the water channeling vanes 58 increase the fin's efficiency.

The new and improved fin 10 of this invention responds to the needs of the swimmer, whether to provide more resistance or to provide better, less turbulent water flow past the fin. Either goal is achieved by judicious placement of the various water channeling vanes 58 on the fin or sole plate 14. No prior art fin has this type of design flexibility.

The swim fin and sole plate with various modular attachments has been described with reference to particular embodiments. However, it should be obvious to those skilled in the art to which this invention pertains that other modifications and enhancements may be made without departing from the spirit and scope of the invention as defined the claims that follow.

I claim:

1. A swim fin adapted to be worn on a foot of a swimmer comprising:

an adjustable channeling means for adjustably and controllably channeling water, said channeling means being selectively rotatable to a specific orientation about an axis normal to the longitudinal and lateral axes of said fin and substantially projecting away from the swim fin and into water about the swim fin so as to channel water flow about the swim fin;

a substrate means for attachment of said channeling means; said substrate means, larger than said foot;

a securing means for securing said substrate means to said foot so that said substrate means is held snugly against the sole of said foot; and an attaching means for attaching said channeling means to said substrate means in a fixed position, clear of said foot.

2. A swim fin, as claimed in claim 1, in which said substrate means and said securing means are formed as a one piece integral molding from a resilient material.

3. A swim fin as claimed in claim 2, in which said resilient material is selected from the group consisting of natural rubber, synthetic rubber, a silicone polymer, and a polyurethane polymer

4. A swim fin, as claimed in claim 1, in which said channeling means is made from a material selected from the group consisting of natural rubber, synthetic rubber, a silicone polymer, and a polyurethane polymer.

5. A swim fin as claimed in claim 1, additionally comprising a pod means, detachably attached to said substrate means, for diverting water from said substrate means in order to permit greater swimming speed.

6. A swim fin, as claimed in claim 5, in which said pod means is made from a material selected from the group consisting of natural rubber, synthetic rubber, a silicone polymer, a polyurethane polymer, a polymeric foam and a lead filled plastic.

7. A swim fin as claimed in claim 1, additionally comprising an extension means of essentially truncated triangular shape, detachably attached to said substrate means, to provide greater surface area to said swim fin and greater swimming power.

8. A swim fin as claimed in claim 1, in which said attaching means is a nut and bolt combination, in which said nut and bolt combination is adapted to be easily turned by hand.

9. A swim fin as claimed in claim 8, in which said nut has a knurled bearing face.

10. A swim fin as claimed in claim 8, in which said bolt has a knurled bearing face.

11. A swim fin as claimed in claim 8, in which said nut and said bolt have knurled bearing faces.

12. A swim fin as claimed in claim 8, additionally comprising means, incorporated into said substrate means, for preventing said nut from rotating.

13. A swim fin as claimed in claim 1, in which said securing means is a threaded insert and bolt combination; said bolt being adapted to be easily turned by hand; said insert being molded into said channeling means.

14. A swim fin as claimed in claim 13, in which said bolt has a knurled bearing face.

15. A swim fin as claimed in claim 1, in which said securing means is adjustable in order to accommodate different sizes of said foot.

16. A swim fin adapted to be worn on a foot of a swimmer; said foot having a sole; said swim fin comprising:

a sole plate having a front portion, a rear portion, an upper surface and a lower surface said lower surface defining a central portion and a peripheral portion; said sole plate being larger than said foot;

means for securing said sole plate to said foot so that said sole plate is held snugly against the sole of said foot;

said sole plate having a plurality of mounting openings which will be clear of said foot after said sole plate is secured to said foot;

an adjustable water channeling vane, having a mounting hole, said channeling vane being selectively rotatable to a specific orientation about an axis normal to the longitudinal and lateral axes of said fin and for adjustably and controllably channeling water, said channeling vane substantially projecting away from the swim fin and into water about the swim fin so as to channel water flow about the swim fin; and means for attaching said water channeling vane to said sole plate in a fixed position through said mounting hole of said water channeling vane and at least one of said mounting openings of said sole plate.

17. A swim fin, as claimed in claim 16, in which said sole plate and said means for securing are formed as a one piece integral molding from a resilient material.

18. A swim fin as claimed in claim 17, in which said resilient material is selected from the group consisting of natural rubber, synthetic rubber, a silicone polymer, and a polyurethane polymer.

19. A swim fin, as claimed in claim 16, in which said water channeling vane is made from a material selected from the group consisting of natural rubber, synthetic rubber, a silicone polymer, and a polyurethane polymer.

20. A swim fin as claimed in claim 16, additionally comprising an essentially hemispherical pod, detachably attached to said lower surface of said sole plate; said essentially hemispherical pod diverting water from said central portion of said lower surface of said sole plate in order to permit greater swimming speed.

21. A swim fin, as claimed in claim 20, in which said hemispherical pod is made from a material selected from the group consisting of natural rubber, synthetic rubber, a silicone polymer, a polyurethane polymer, a polymeric foam and a lead filled plastic.

22. A swim fin, as claimed in claim 16, additionally comprising a fin extension of essentially truncated triangular shape, detachably attached to said front portion of said sole plate, to provide greater surface area to said swim fin and greater swimming power.

23. A swim fin, as claimed in claim 16, in which said means for attaching is a nut and bolt combination, in which said nut and bolt combination is adapted to be easily turned by hand.

24. A swim fin as claimed in claim 23, in which said nut has a knurled bearing face.

25. A swim fin as claimed in claim 23, in which said bolt has a knurled bearing face.

26. A swim fin as claimed in claim 23, in which said nut and said bolt have knurled bearing faces.

27. A swim fin as claimed in claim 23, additionally comprising anti-rotation means, incorporated into said sole plate, for preventing said nut from rotating.

28. A swim fin as claimed in claim 16, in which said means for securing is a threaded insert and bolt combination; said bolt being adapted to be easily turned by hand; said threaded insert being molded into said mounting hole of said water channeling vane.

29. A swim fin as claimed in claim 28, in which said bolt has a knurled bearing face.

30. A swim fin as claimed in claim 16, in which said means for securing is adjustable in order to accommodate different sizes of said foot.

31. A swim fin adapted to be worn on a foot of a swimmer; said foot having a sole and a heel; said swim fin comprising:

a sole plate having a front portion, a rear portion, an upper surface and a lower surface; said lower surface defining a central portion and a peripheral portion; said sole plate being larger than said foot;

a first arcuate shaped flap integral with and extending upwards and forwards from said rear portion of said sole plate, which forms a tunnel of variable diameter into which said foot can be inserted;

a heel strap of a specific length, attached to said arcuate shaped flap; which will fit around the heel of said foot after said foot is inserted into said tunnel formed by said first arcuate shaped flap;

means for adjusting the length of said heel strap so that said upper surface of said sole plate is held snugly against the sole of said foot after said foot is inserted into said tunnel;

said sole plate having a plurality of mounting openings, which are clear of said foot after said foot is inserted into said tunnel;

an adjustable water channeling vane having a mounting hole, said channeling vane being selectively rotatable to a specific orientation about an axis normal to the longitudinal and lateral axes of said fin and for adjustably and controllably channeling water, said channeling vane substantially projecting away from the swim fin and into water about the swim fin so as to channel water flow about the swim fin; and means for attaching said water channeling vane to said sole plate in a fixed position through said mounting hole of said water channeling vane and at least one of said mounting openings of said sole plate.

32. A swim fin as claimed in claim 31, in which said sole plate and said arcuate flap are formed as a one piece integral molding from a resilient material.

33. A swim fin as claimed in claim 32, in which said resilient material is selected from the group consisting of natural rubber, synthetic rubber, a silicone polymer, and a polyurethane polymer.

34. A swim fin, as claimed in claim 31, in which said water channeling vane is made from a material selected from the group consisting of natural rubber, synthetic rubber, a silicone polymer, and a polyurethane polymer.

35. A swim fin as claimed in claim 31, additionally comprising an essentially hemispherical pod, detachably attached to said lower surface of said sole plate; said essentially hemispherical pod diverting water from said central portion of said lower surface of said sole plate in order to permit greater swimming speed.

36. A swim fin, as claimed in claim 35, in which said hemispherical pod is made from a material selected from the group consisting of natural rubber, synthetic rubber, a silicone polymer, a polyurethane polymer, a polymeric foam and a lead filled plastic.

37. A swim fin as claimed in claim 31, additionally comprising a fin extension of essentially truncated triangular shape, detachably attached to said front portion of said sole plate to provide greater surface area of said swim fin and to permit greater swimming power.

38. A swim fin as claimed in claim 31, in which said means for attaching is a nut and bolt combination, in which said nut and bolt combination is adapted to be easily turned by hand.

39. A swim fin as claimed in claim 38, in which said bolt has a knurled bearing face.

40. A swim fin as claimed in claim 38, in which said nut has a knurled bearing face.

41. A swim fin as claimed in claim 38, in which said nut and said bolt have knurled bearing faces.

42. A swim fin as claimed in claim 38, additionally comprising anti-rotation means, incorporated into said sole plate, for preventing said nut from rotating.

43. A swim fin as claimed in claim 31, in which said means for attaching is a threaded insert and bolt combination; said bolt being adapted to be easily turned by hand; said threaded insert being molded into said mounting hole of said water channeling vane.

44. A swim fin as claimed in claim 43, in which said bolt has a knurled bearing face.

45. A swim fin as claimed in claim 31, in which said means for adjusting are selected from the group consisting of buckles, and hook and pile fasteners.

46. A swim fin as claimed in claim 31, additionally comprising:

a second arcuate shaped flap integral with and extending upwards and forwards from said rear portion of said sole plate, which with said first arcuate shaped flap forms a tunnel of variable diameter into which said foot can be inserted; and means for adjusting the diameter of said tunnel formed by said first and second arcuate shaped flaps.

47.A swim fin as claimed in claim 46, in which said means for adjusting are selected from the group consisting of buckles, and hook and pile fasteners.

48. A method of enhancing the effectivity of a foot of a swimmer; said foot having a sole and a heel; said method comprising the steps of:

(a) providing a swim fin which includes:

a sole plate having a front portion, a rear portion, an upper surface and a lower surface; said lower surface defining a central portion and a peripheral portion; said sole plate being larger than said foot;

a first arcuate shaped flap, integral with and extending upwards and forwards from said rear portion of said sole plate, which forms a tunnel of variable diameter into which said foot can be inserted;

a heel strap of a specific length, attached to said arcuate shaped flap, which will fit around the heel of said foot after it is inserted into the tunnel formed by said arcuate shaped flap;

means for adjusting the length of said heel strap so that said sole plate is held snugly against the sole of said foot after said foot is inserted into said tunnel;

said sole plate having a plurality of mounting openings, which are clear of said foot after said foot is inserted into said tunnel;

(b) providing an adjustable water channeling vane having a mounting hole, said channeling vane being selectively rotatable to a specific orientation about an axis normal to the longitudinal and lateral axes of said fin and adjustably and controllably channeling water, said channeling vane substantially projecting away from the swim fin and into the water about the swim fin so as to channel water flow about the swim fin;

(c) providing means for attaching said water channeling vane to said sole plate in a fixed position through said mounting hole of said water channeling vane and at least one of said mounting openings of said sole plate;

(d) attaching said water channeling vane to said sole plate through said mounting hole of said water channeling vane and at least one of said mounting openings of said sole plate using said means for attaching;

(e) inserting said foot into said tunnel; and (f) snugly securing said sole plate against the sole of said foot by adjusting said means for adjusting the length of said heel strap.

49. A method as claimed in claim 48, in which said means for adjusting are selected from the group consisting of buckles, and hook and pile fasteners.

50. A method as claimed in claim 48, in which said sole plate and said first arcuate shaped flap are formed as a one piece integral molding from a resilient material.

51. A method as claimed in claim 50, in which said resilient material is selected from the group consisting of natural rubber, synthetic rubber, a silicone polymer, and a polyurethane polymer.

52. A method as claimed in claim 48, additionally comprising the steps of:

(a) providing said swim fin with a second arcuate shaped flap integral with and extending upwards and forwards from said rear portion of said sole plate, which additionally with said first arcuate shaped flap forms a tunnel of variable diameter into which said foot can be inserted; and (b) providing said swim fin with means for adjusting the diameter of said tunnel formed by said first and second arcuate shaped flaps.

53. A method as claimed in claim 52, in which said means for adjusting are selected from the group consisting of buckles, and hook and pile fasteners.

54. A method as claimed in claim 52, in which said sole plate and said first and said second arcuate shaped flaps are formed as a one piece integral molding from a resilient material.

55. A method as claimed in claim 54, in which said resilient material is selected from the group consisting of natural rubber, synthetic rubber, a silicone polymer, and a polyurethane polymer.

56. A method, as claimed in claim 48, in which said water channeling vane is made from a material selected from the group consisting of natural rubber, synthetic rubber, a silicone polymer, and a polyurethane polymer.

57. A method as claimed in claim 48, additionally comprising the step of providing an essentially hemispherical pod, detachably attached to said lower surface of said sole plate; said essentially hemispherical pod diverting water from said central portion of said lower surface of said sole plate in order to permit greater swimming speed.

58. A swim fin, as claimed in claim 57, in which said hemispherical pod is made from a material selected from the group consisting of natural rubber, synthetic rubber, a silicone polymer, a polyurethane polymer, a polymeric foam and a lead filled plastic.

59. A method as claimed in claim 48, additionally comprising a fin extension of essentially truncated triangular shape, detachably attached to said front portion of said sole plate to provide greater surface area to said swim fin and greater swimming power.

60. A method as claimed in claim 48, in which said means for attaching is a nut and bolt combination, in which said nut and bolt combination is adapted to be easily turned by hand.

61. A method as claimed in claim 60, in which said nut has a knurled bearing face.

62. A method as claimed in claim 60, in which said bolt has a knurled bearing face.

63. A method as claimed in claim 60, in which said nut and said bolt have knurled bearing faces.

64. A method as claimed in claim 60, additionally comprising anti-rotation means, incorporated into said sole plate, for preventing said nut from rotating.

65. A method as claimed in claim 48, in which said means for securing is a threaded insert and bolt combination; said bolt being adapted to be easily turned by hand; said insert being molded into said mounting hole of said water channeling vane.

66. A method as claimed in claim 65, in which said bolt has a knurled bearing face.

67. A method of enhancing the effectivity of a swim fin having a blade said blade having an upper surface and a lower surface; said lower surface defining a central portion and a peripheral portion; said method comprising the steps of:

(a) providing a template showing where to drill mounting holes through said blade of said swim fin;

(b) providing an adjustable water channeling vane having a mounting hole, said channeling vane being selectively rotatable to a specific orientation about an axis normal to the longitudinal and lateral axes of said fin and for adjustably and controllably channeling water, said channeling vane substantially projecting away from the swim fin and into water about the swim fin so as to channel water flow about the swim fin;

(c) providing means for securing said water channeling vane to said swim fin;

(d) drilling holes through said swim fin in locations defined by said template; and (e) attaching said water channeling vane to said blade of said swim fin through said mounting hole of said water channeling vane and through at least one of said mounting holes drilled through said blade of said swim fin using said means for securing.

68. A method, as claimed in claim 67, in which said water channeling vane is made from a material selected from the group consisting of natural rubber, synthetic rubber, a silicone polymer, and a polyurethane polymer.

69. A method as claimed in claim 67, additionally comprising the steps of:

(a) providing an essentially hemispherical pod;

(b) attaching said essentially hemispherical pod to said central portion of said lower surface of said blade of said fin; said essentially hemispherical pod diverting water from said central portion of said lower surface of said blade in order to permit greater swimming speed.

70. A method, as claimed in claim 69, in which said essentially hemispherical pod is made from a material selected from the group consisting of natural rubber, synthetic rubber, a silicone polymer, a polyurethane polymer, a polymeric foam and a lead filled plastic.

71. A method, as claimed in claim 67, in which said means for securing is a nut and bolt combination, in which said nut and bolt combination is adapted to be easily turned by hand.

72. A method, as claimed in claim 71, in which said nut has a knurled bearing face.

73. A method, as claimed in claim 70, in which said bolt has a knurled bearing face.

74. A method, as claimed in claim 71, in which said nut and said bolt have knurled bearing faces.

75. A method, as claimed in claim 67, in which said means for securing is a threaded insert and bolt combination; said bolt being adapted to be easily turned by hand; said insert being molded into said mounting hole of said water channeling vane.

76. A method, as claimed in claim 75, in which said bolt has a knurled bearing face.

77. A swim fin adapted to be worn on a foot of a swimmer comprising:

an adjustable channeling means for adjustably and controllably channeling water, said channeling means being selectively rotatable to a specific orientation about an axis normal to the longitudinal and lateral axes of said fin and substantially projecting away from the swim fin and into water about the swim fin so as to channel water flow about the swim fin; and an attaching means for attaching said channeling means to said swim fin in a fixed position, clear of said foot.

78. A swim fin, as claimed in claim 77, in which said channeling means is made from a material selected from the group consisting of natural rubber, synthetic rubber, a silicone polymer, and a polyurethane polymer.

79. A swim fin as claimed in claim 77, additionally comprising a pod means, detachably attached to said swim fin, for diverting water from said swim fin in order to permit greater swimming speed.

80. A swim fin, as claimed in claim 79, in which said pod means is made from a material selected from the group consisting of natural rubber, synthetic rubber, a silicone polymer, a polyurethane polymer, a polymeric foam and a lead filled plastic.

81. A swim fin as claimed in claim 77, in which said attaching means is a nut and bolt combination, adapted to be easily turned by hand.

82. A swim fin as claimed in claim 81, in which said nut has a knurled bearing face.

83. A swim fin as claimed in claim 81, in which said bolt has a knurled bearing face.

84. A swim fin as claimed in claim 81, in which said nut and said bolt have knurled bearing faces.

85. A swim fin as claimed in claim 77, in which said attaching means is a threaded insert and bolt combination; said bolt being adapted to be easily turned by hand; said insert being molded into said channeling means.

86. A swim fin as claimed in claim 85, in which said bolt has a knurled bearing face.

87. A swim fin adapted to be worn on a foot of a swimmer comprising:

an adjustable water channeling vane, said vane for adjustably and controllably channeling water, said channeling vane being selectively rotatable to a specific orientation about an axis normal to the longitudinal and lateral axes of said fin and substantially projecting away from the swim fin and into water about the swim fin so as to channel water flow about the swim fin; and means for attaching said water channeling vane to said swim fin in a fixed position, clear of said foot.

88. A swim fin, as claimed in claim 87, in which said water channeling vane is made from a material selected from the group consisting of natural rubber, synthetic rubber, a silicone polymer, and a polyurethane polymer.

89. A swim fin as claimed in claim 87, additionally comprising a hemispherical pod, detachably attached to said swim fin, for diverting water from said swim fin in order to permit greater swimming speed.

90. A swim fin, as claimed in claim 89, in which said hemispherical pod is made from a material selected from the group consisting of natural rubber, synthetic rubber, a silicone polymer, a polyurethane polymer, a polymeric foam and a lead filled plastic.

91. A swim fin as claimed in claim 87, in which said means for attaching is a nut and bolt combination, adapted to be easily turned by hand.

92. A swim fin as claimed in claim 91, in which said nut has a knurled bearing face.

93. A swim fin as claimed in claim 91, in which said bolt has a knurled bearing face.

94. A swim fin as claimed in claim 91, in which said nut and said bolt have knurled bearing faces.

95. A swim fin as claimed in claim 87, in which said means for attaching is a threaded insert and bolt combination; said bolt being adapted to be easily turned by hand; said insert being molded into said water channeling vane.

96. A swim fin as claimed in claim 95, in which said bolt has a knurled bearing face.

* * * * *